United States Patent [19]

Connolly et al.

[11] Patent Number: 4,889,506

[45] Date of Patent: Dec. 26, 1989

[54] SOLDER DELIVERY DEVICE

[75] Inventors: Joseph Connolly; Neil L. Holt, both of Redwood City; Anthony R. W. Richardson, Los Altos Hills; Jay Siedenburg, Woodside, all of Calif.

[73] Assignee: Raychem Corporation, Menlo Park, Calif.

[21] Appl. No.: 266,418

[22] Filed: Nov. 3, 1988

[51] Int. Cl.[4] ..... H01R 4/02

[52] U.S. Cl. ..... 439/874; 29/860; 174/84 R; 228/56.3

[58] Field of Search ..... 29/860; 439/874, 875; 174/84 R; 228/56.3, 179

[56] References Cited

U.S. PATENT DOCUMENTS

| | | | |
|---|---|---|---|
| 3,326,442 | 6/1967 | Fattor | 439/874 |
| 4,553,809 | 11/1985 | Holt | 439/874 |
| 4,634,213 | 1/1987 | Larsson et al. | 439/875 |
| 4,687,280 | 8/1987 | Toy et al. | 439/874 |

*Primary Examiner*—Gary F. Paumen

*Attorney, Agent, or Firm*—Edith A. Rice; Herbert G. Burkard

[57] ABSTRACT

A self-contained solder delivery device comprises a housing, a quantity of solder together with flux and a pressuring means for forcing the solder from the housing. The device can be used in a connector for use in connecting the conductors of electric power cables.

14 Claims, 5 Drawing Sheets

SOLDER DELIVERY DEVICE

BACKGROUND OF THE INVENTION

U.S Pat. Nos. 4,634,213 to Larsson et al, 4,687,280 to Toy et al and 4,553,809 to Holt, the disclosures of which are incorporated herein by refernnce, relate to a connector for power distribution cables. The connector comprises a metal sleeve having an open end for receiving a conductor of the cable and a closed end. In a preferred embodiment the sleeve is provided with a slug of solder and pressuring means to urge the solder between the conductor and the metal sleeve to make a solder joint between them. The metal sleeve can be a terminating lug or two such sleeves can be joined together to form a connector for splicing conductors together. In preferred embodiments, the pressurizing means is a piston behind which is a gas generating substance. Upon heating, gas is generated and creates sufficient pressure behind the piston that on melting of the solder, the gas drives the piston forcing the molten solder between the conductor and metal sleeve. The piston is preferably an expanding piston as disclosed in U.S. Pat No. 4,687,280 to provide an effective seal to contain the gas as it is generated. The solder can be directed to the center strands of the conductor as disclosed in U.S. Pat. No. 4,553,809.

Manufacture of the connector requires numerous steps with the individual placement of each of the elements and sealing of solder and pressuring means into the connector. This invention provides a simplified approach to manufacturing this connector.

SUMMARY OF THE INVENTION

This invention provides a self-contained solder delivery device which can be used with a connector for the conductors of electrical power cables. The delivery device can be installed within the connector or can be positioned outside the connector communicating with the inside thereof through an aperature.

One aspect of this invention comprises a self-contained solder delivery device comprising:

(a) a tubular housing having tubular side walls, one end of which is closed and the other end of which contains an opening;

(b) a quantity of solder and flux positioned within the housing toward the open end thereof; and (c) means within the housing between said solder and said closed end for pressuring the solder through said opening when the solder is molten.

Another aspect of this invention comprises a connector for electrical conductors comprising:

(i) at least one metallic tubular sleeve having at least one open end sized to receive an electrical conductor, and (ii) a self-contained solder delivery device comprising:

(a) a tubular housing having tubular side walls, one end of which is closed and the other end of which contains an opening extending at least partially thereacross;

(b) a quantity of solder positioned within the housing such that it extends across said opening; and (c) means within the housing between said solder and said closed end for pressuring the solder through said opening when the solder is molten;

said delivery means being located so that the molten solder is pressured between the sleeve and the conductor to form a solder joint therebetween.

A further aspect of this invention comprises a method for connecting an electrical conductor comprising:

(I) selecting a connector comprising:

(i) at least one metallic tubular sleeve having at least one open end sized to receive said conductor to be connected, and (ii) a self contained solder delivery device comprising:

(a) a tubular housing having tubular side walls, one end of which is closed and the other end of which contains an opening extending at least partially thereacross;

(b) a quantity of solder positioned wihin the housing such that it extends across said opening; and (c) means within the housing between said solder and said closed end for pressuring the solder through said opening when the solder is molten;

(II) placing said conductor in said sleeve;

(III) positioning the self-contained solder delivery means so that on heating the molten solder is delivered between the conductor and the metal sleeve;

(IV) heating the self-contained delivery means so that solder is delivered between the conductor and metal sleeve; and (V) cooling to solidify the solder and form a solder joint between the conductor and metal sleeve.

DETAILED DESCRIPTION OF THE INVENTION

The self-contained solder delivery device of this invention comprises a tubular housing having tubular side walls, one end of which is enclosed and the other end of which contains an opening. The housing is preferably of metal such as copper, brass or aluminum. The closed end can be integral with the side walls, e.g. the housing can be formed in the shape of a cup. Alternatively, a metal disk can be inserted and secured to the side walls toward thereof, for example by crimping the ends of the tubular side wall around the edges of the disk, welding or soldering the disk to the side walls, or the like. The other end of the housing has an opening therein. The opening can extend substantially the entire area enclosed by the side walls but preferably, a disk of metal material having a central aperature is secured to the side walls towards this open end. As discussed more fully below, solder is directed through the opening.

In an embodiment of the invention, the housing is provided with an outlet extending from the opening in the end of the housing. The outlet comprises a short metal tube which may be provided withthreads for being secured to a substrate to which solder is to be delivered.

The housing contains a quantity of solder. The solder is generally provided in the form of a solid slug, but other forms such as paste, powder, pellets or the like can be used, if desired. The solder flux is preferably positioned so that it flows through the opening in the end of the housing before the solder. The flux selected should, of course, have the appropriate activation temperature for the solder being used and the substrates to be joined.

A piston is provided adjacent the solder located toward the closed end. The piston can be of any material which is capable of withstanding the heat employed to melt the solder. In a preferred embodiment employing a gas generating driver, the piston preferably expands on heating to form a gas-tight seal with the tubular housing which remains gas-tight as the piston slides in the housing. Such a piston is described in above mentioned U.S. Pat. No. 4,687,280 to Toy et al, the disclosure of which is incorporated by reference herein. In this embodiment, the piston is preferably of polymeric material, such as cross-linked polyethylene. The piston can be shaped so that uniform, controlled pressure is exerted on the piston. When used with a gas generating driver, the piston can be provided with a cavity facing the driver to provide space for the generated gas.

The driver is positioned between the piston and the closed end of the housing. The driver can be mechanical means, such as a coiled spring held in compression by the solid solder. When the solder melts, the spring expands, forcing the piston to push the solder through the opening at the open end of the housing. A preferred driver is a gas generating substance. Such a substance is disclosed in above mentioned U.S. Pat. Nos. 4,634,213 to Larsson and 4,553,809 to Holt, the disclosures of which are incorporated by reference herein. Other drivers, such as, the pressuring means referred to in the '213 patent can be used.

BRIEF DESCRIPTION OF THE DRAWINGS

Referring now to the drawing, FIG. 1 illustrates a self-contained solder delivery device 10 in accordance with this invention comprises a housing 12 of aluminum, copper, brass or other heat resisting material, preferably having high thermal conductivity surrounding a solder slug 14, piston 16 and driver 18. Piston 16 is ultra high molecular weight polyethylene and on heating responds to provide a gas tight seal with the side walls of the housing. Groove 17 in the piston is provided to minimize sliding friction between the piston and the housing. Driver 18 is a gas generating material comprising a cross-linked silicone resin containing a nitrogen blowing agent, which when heated generates a gas which creates pressure behind the piston. Indentation 19 is provided on the bottom of the piston to provide space for the generated gas to prevent excessive forces from being applied prematurely. Solder flux 20 is positioned in an indentation 22 formed on the surface of the solder slug. A disk 24 of low melting solder is positioned over the flux and a metal cup 26 having a hole 28 is positioned over disk 24. The components are retained in the housing by means of crimp 29.

An alternate arrangement of the components of the solder delivery device of this invention is shown in FIG. 2, where components common to FIG. 1 are similarly numbered. In FIG. 2, housing 12 contains driver 18, piston 16 and solder slug 14 as in FIG. 1. In FIG. 2, a metal cup 32 is provided to hold the solder slug 14. Flux 20 is maintained in indentation 22 on the surface of the solder slug 14 and low melting solder disk 24 is positioned over the flux. Crimp 29 retains the components in the housing 12. The open end 34 of the housing through which solder is to flow is substantially completely open.

To use the solder delivery device, the housing is heated, for example by applying a flame from a propane torch or similar device, electric heating, radiant heating, application of pyrotechnic material to the surface, induction heating or the like. As heat is applied, the solder disk melts permitting the flux to outgas and flow from the housing. Gas generated by the driver builds up pressure behind the piston so that when the solder melts, the piston is forced to slide toward the open end, pushing the solder out of the housing.

By appropriate positioning of the open end of the housing, molten solder is delivered to the substrates to be soldered together. Of particular interest is delivering the solder to a connector for electrical power cables.

Figure 1:
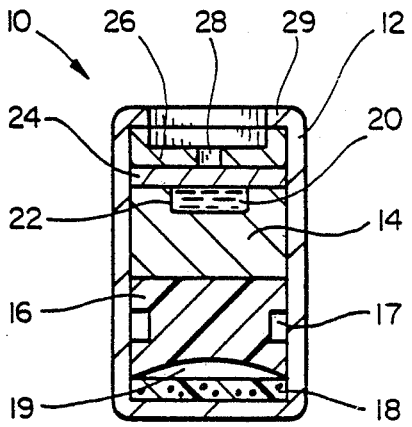
FIG. 1 is a transverse cross-section of a solder delivery device of this invention.
Figure 2:
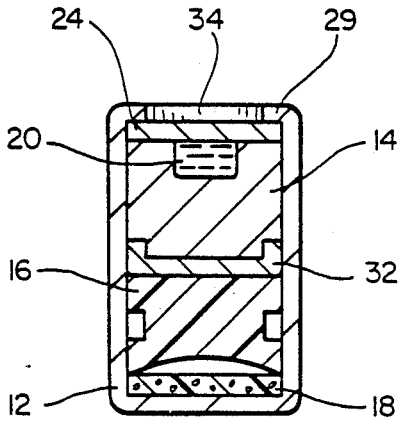
FIG. 2 is a transverse cross-section of another embodiment of the solder delivery device of this invention.
Figure 3A:
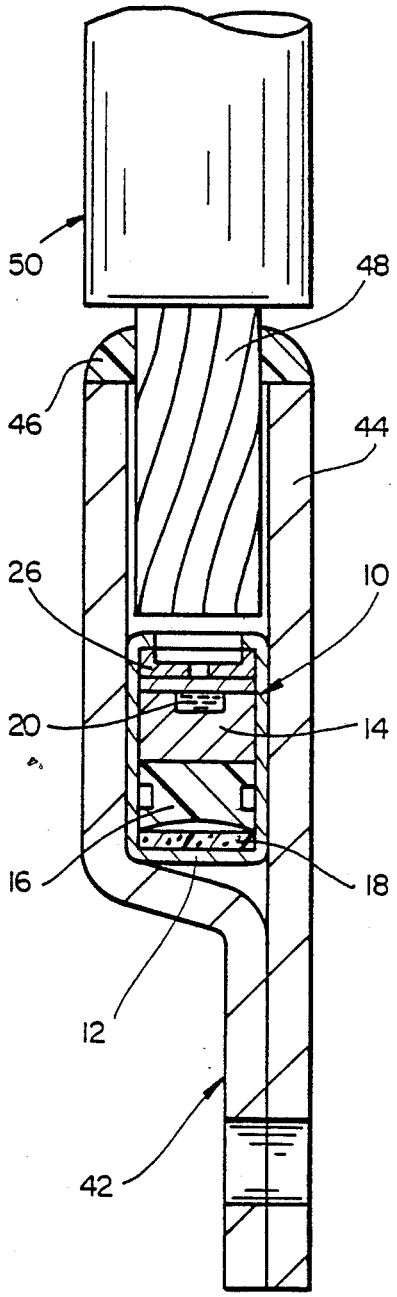
FIG. 3A is a transverse cross-section of a terminating lug having a metal sleeve and incorporating a solder delivery of this invention prior to delivery of the solder for connecting a conductor to the lug.
Figure 3B:
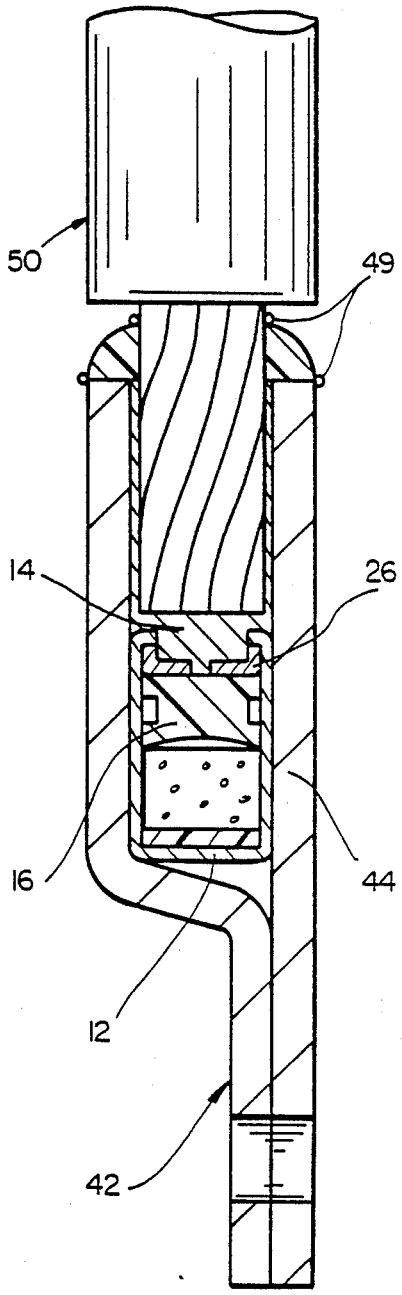
FIG. 3B shows the terminating lug of FIG. 3A after delivery of the solder.

One method of using the solder delivery device of FIG. 1 with a terminating lug is shown in FIG. 3A and 3B. In FIG. 3A, terminating lug 42 having metal sleeve 44 is provided with sealing compound 46. Conductor 48 of cable 50 is inserted into metal sleeve 44. Solder delivery means 10 comprises housing 12, driver 18, piston 16, solder slug 14, flux 20, low melting solder disk 24, metal cup 26 held in the housing by the crimped edge at the end of the housing. The lug and thus the solder delivery device is heated. The driver forces the piston which in turn pushes the solder out of the open end of the solder delivery device.

FIG. 3B shows the completed solder joint with solder 14 having been forced between conductor 48 the metal wall 44 of lug 42. The solder delivery device now empty of solder. Piston 16 has moved toward the open end of housing 12. Solder beads 49 appear at the edges of the sealing compound 46 indicating that solder substantially fills the connection.

Figure 4:
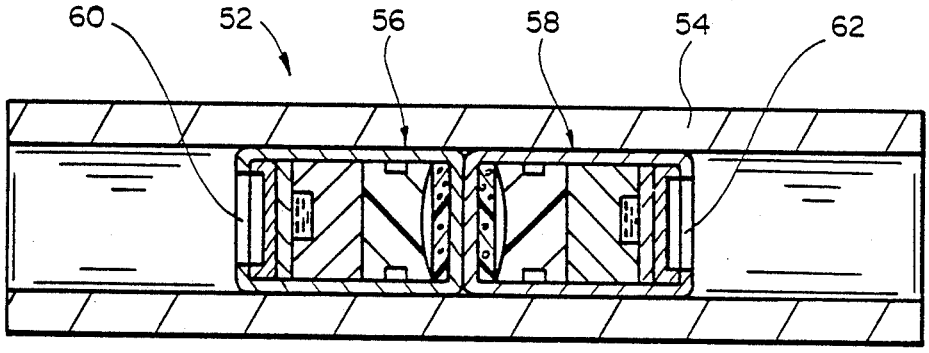
FIG. 4 is a transverse cross-section of a splice connector containing two solder delivery devices for splicing together two conductors (not shown).

FIG. 4 illustrates a splice connector 52 which can be used for joining conductors of electric power cables. The connector 52 comprises metallic sleeve 54 which contains back-to-back self-contained solder delivery devices 56 and 58. The open ends 60 and 62 of the solder delivery devices are directed toward the ends of metal sleeve 54 which receive the cable conductors.

Figure 5:
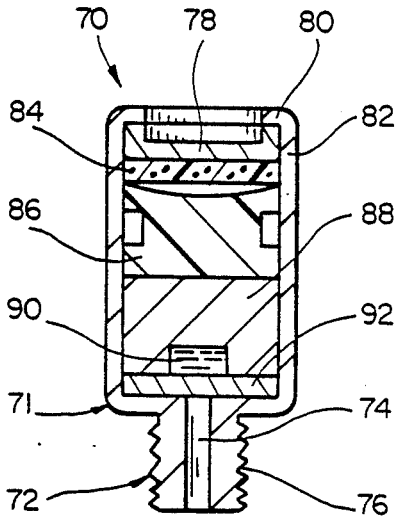
FIG. 5 is a transverse cross-section of a solder delivery device of this invention provided with a threaded outlet.

FIG. 5 illustrates another embodiment of the invention. In solder delivery device 70, the housing 71 is provided with an outlet 72 having a bore 74 therethrough for the passage of molten solder. The outlet, in this embodiment, is provided with threads 76 which are used to secure the device through matching complimentary threads through an aperature of the connector with which it is to be used (see FIGS. 6 and 7). In FIG. 5, a metal sealing cup 78 is held in place by the crimped end 80 of the side wall of housing 82. Adjacent sealing cup 78 is driver 84 and piston 86. As in previous embodiments, driver 84 comprises a cross-linked silicone resin containing a nitrogen blowing agent which produces gas on heating to build up pressure behind piston 86.

Solder 88, flux 90 and low melting disk 92 are positioned on the other side of piston 86. As heat is applied the low melting solder disk 92 melts to permit outgassing of the flux. The solder then melts and pressure behind the piston due to the gas generated by the driver forces the flux and solder through the bore 74 of outlet 76.

Figure 6:
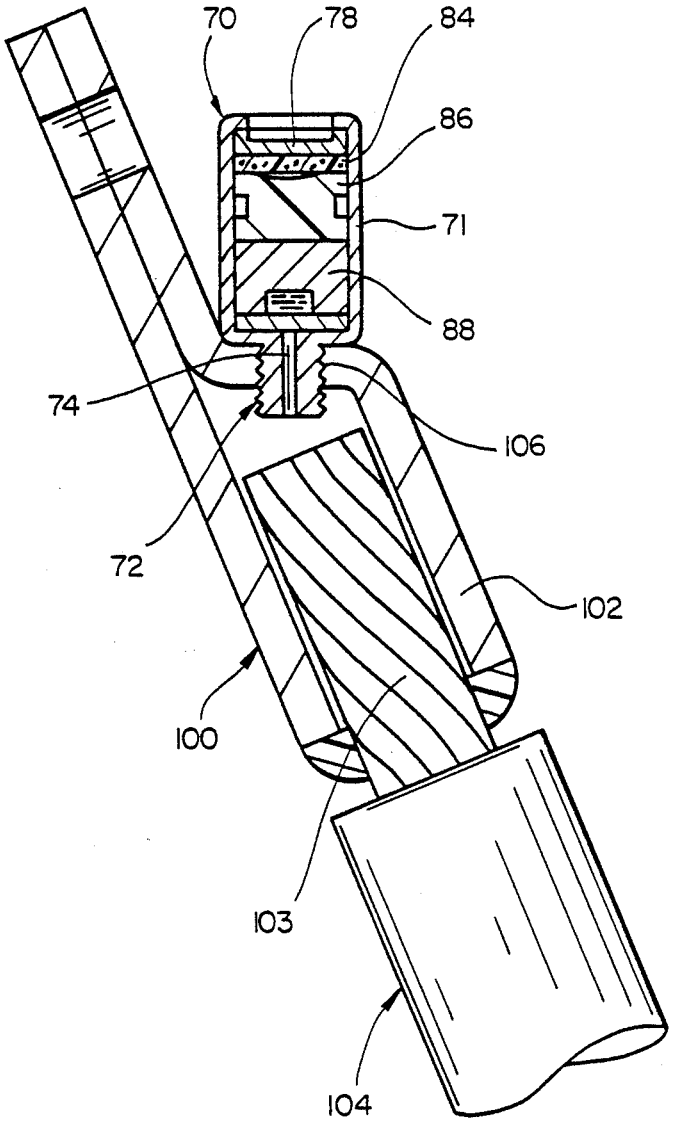
FIG. 6 is a transverse cross-section of a terminating lug fitted with the delivery device of FIG. 5.
Figure 7:
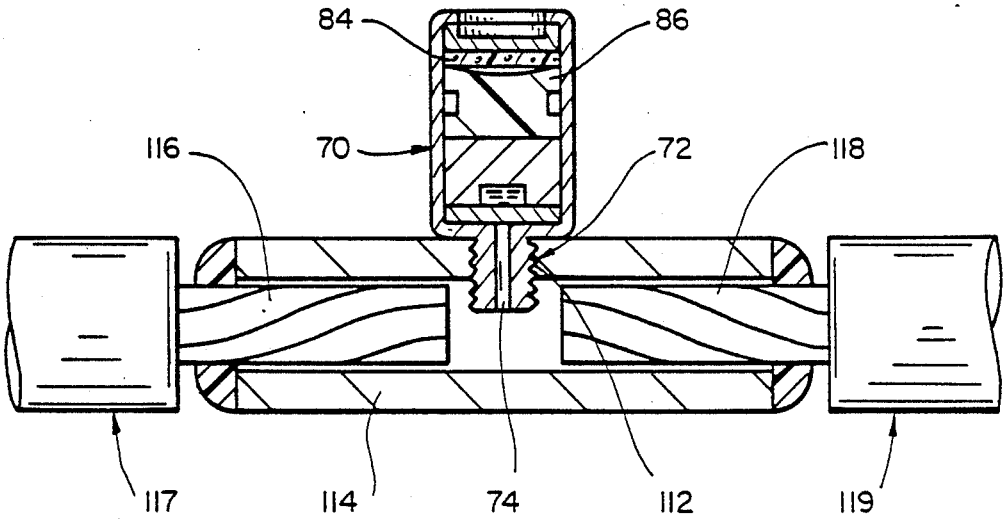
FIG 7 is a transverse cross-section of a splice connector fitted with the solder delivery device of FIG. 5.

As shown in FIGS. 6 and 7, the solder delivery device 70 can be connected to a lug or splice connector so that the solder is delivered and forced to flow between the conductor and connector. In FIG. 6, solder delivery device FIG. 5 is secured to lug 100 for delivering solder between metal sleeve 102 and conductor 103 of cable 104. Outlet 72 is positioned in a hole 106 of metal sleeve 102. Threads on the outlet of the delivery device and hole in the metal sleeve hold the delivery means in place. When the solder delivery device is heated, solder 88 melts and is forced by piston 86 pressured by driver 84 force through the bore 74 of outlet 72 into the metal sleeve 102 and between the conductor 103 and metal sleeve 102 to form a solder joint between them. Metal sealing cup 78 remains in place effectively forming a closed end for housing 71.

In FIG. 7, the outlet 72 of solder delivery device 70 of FIG. 5 is positioned in hole 112 of metal sleeve 114. In metal sleeve 114 are placed conductors 116 and 118 of cables 117 and 119, respectively. In this embodiment when the solder delivery device 70 is heated, solder is forced through bore 74 into the metal sleeve and between the metal sleeve and each of conductors 116 and 118.

What is claimed is:

1. A self-contained solder delivery device comprising:

(a) a tubular housing having tubular side walls, one end of which is closed and the other end of which contains an opening;

(b) a quantity of solder and flux positioned within the housing toward the open end thereof; and (c) means within the housing between said solder and said closed end for pressuring the solder through said opening when the solder is molten, and wherein said solder, flux, and pressuring means substantially fill the housing so that a substantial length of a conductor cannot be inserted therein.

2. A device in accordance with claim 1, wherein the means for pressuring the solder through the opening when the solder is molten comprises a piston and driver.

3. A device in accordance with claim 2, wherein the piston is capable of expanding radially when heated to a temperature below the melting temperature of the solder.

4. A device in accordance with claim 2, wherein the driver comprises a gas generating substance.

5. A connector for an electrical conductor, comprising:

(i) at least one metallic tubular sleeve having at least one open end sized to receive an electrical conductor, and (ii) a self-contained solder delivery device comprising:

(a) a tubular housing having tubular side walls, one end of which is closed and the other end of which contains an opening extending at least partially thereacross;

(b) a quantity of solder and flux positioned within the housing such that said quantity extends across said opening; and (c) means within the housing between said solder and said closed end for pressuring the solder through said opening when the solder is molten;

said delivery device being joined to the sleeve so that the molten solder is pressured between the sleeve and the conductor to form a solder joint therebetween.

6. A device in accordance with claim 5, wherein the means for pressuring the solder through the opening when the solder is molten comprises a piston and driver.

7. A device in accordance with claim 6, wherein the piston is capable of expanding radially when heated to a temperature below the melting temperature of the solder.

8. A device in accordance with claim 6, wherein the driver comprises a gas generating substance.

9. A connector in accordance with claim 5, wherein said solder delivery device is located within said metallic sleeve.

10. A connector in accordance with claim 5, wherein said solder delivery device is located outside said metallic sleeve.

11. A connector in accordance with claim 10, wherein said solder delivery device further comprises an outlet and said metallic sleeve is provided with a hole in which said outlet is positioned.

12. A method for connecting an electrical conductor, comprising:

(I) selecting a connector comprising:

(i) at least one metallic tubular sleeve having at least one open end sized to receive said conductor to be connected, and (ii) a self contained solder delivery device comprising:

(a) a tubular housing having tubular side walls, one end of which is closed and the other end of which contains an opening extending at least partially thereacross;

(b) a quantity of solder and flux positioned within the housing such that said quantity extends across said opening; and (c) means within the housing between said solder and said closed end for pressuring the solder through said opening when the solder is molten;

(II) placing said conductor in said sleeve;

(III) joining the self-contained solder delivery device to said sleeve so that on heating the molten solder is delivered between the conductor and the metal sleeve;

(IV) heating the self-contained delivery device so that solder is delivered between the conductor and the metal sleeve; and (V) cooling to solidify the solder and form a solder joint between the conductor and metal sleeve.

13. A method in accordance with claim 12, wherein the step of joining the solder delivery device comprises placing the solder delivery device within said metallic sleeve.

14. A method in accordance with claim 12, wherein the solder delivery device further comprises an outlet and said sleeve further comprises a hole and the step of joining the solder delivery device comprises placing said outlet in the hole.

* * * * *